US005210543A

United States Patent [19]

Kurtz

[11] Patent Number: 5,210,543

[45] Date of Patent: May 11, 1993

[54] FEED WAVEGUIDE FOR AN ARRAY ANTENNA

[75] Inventor: Louis A. Kurtz, Woodland Hills, Calif.

[73] Assignee: Hughes Aircraft Company, Los Angeles, Calif.

[21] Appl. No.: 807,336

[22] Filed: Dec. 16, 1991

Related U.S. Application Data

[63] Continuation of Ser. No. 287,364, Dec. 20, 1988, abandoned.

[51] Int. Cl.[5] ..... H01R 13/10

[52] U.S. Cl. ..... 343/771

[58] Field of Search ..... 343/770, 771; 333/113, 333/114, 254

[56] References Cited

U.S. PATENT DOCUMENTS

| | | | |
|---|---|---|---|
| 3,243,818 | 3/1966 | Holtzman | 343/771 |
| 3,328,728 | 6/1967 | Young | 333/114 |
| 3,518,576 | 6/1970 | Algeo | 333/114 |
| 4,121,220 | 10/1978 | Scillieri et al. | 343/771 |
| 4,429,313 | 1/1984 | Muhs et al. | 343/771 |
| 4,792,770 | 12/1988 | Parekh et al. | 333/113 |
| 4,821,044 | 4/1989 | Kurtz | 343/771 |

FOREIGN PATENT DOCUMENTS

| | | |
|---|---|---|
| 1933950 | 1/1970 | Fed. Rep. of Germany . |
| 1180714 | 11/1970 | United Kingdom . |

OTHER PUBLICATIONS

Stumper, New Non Directional Waveguide Multicoupler as Part of a Simple Microwave six-port Reflectometer, Electronics Letters, Sep. 2, 1982, vol. 18, No. 18, pp. 757–758.

*Primary Examiner*—Michael C. Wimer

*Attorney, Agent, or Firm*—C. D. Brown; R. M. Heald; W. K. Denson-Low

[57] ABSTRACT

An improved feed waveguide 15 for an antenna 10 is disclosed which reduces coupling junction phase errors. The improved feed waveguide 15 of the present invention includes first and second slotted parallel walls 35*a* and 37*a* along the length thereof. The first wall 35*a* includes a first elongate slot 27 therethrough having a first longitudinal axis 42. The second wall 37*a* includes a second elongate slot 32 which is located on the second wall 37*a* opposite the first slot 27 on the first wall 35*a*. The second slot 32 has a longitudinal axis 44 which is orthogonal to the longitudinal axis 42 of the first slot 27.

1 Claim, 3 Drawing Sheets

FIG. 1(a)
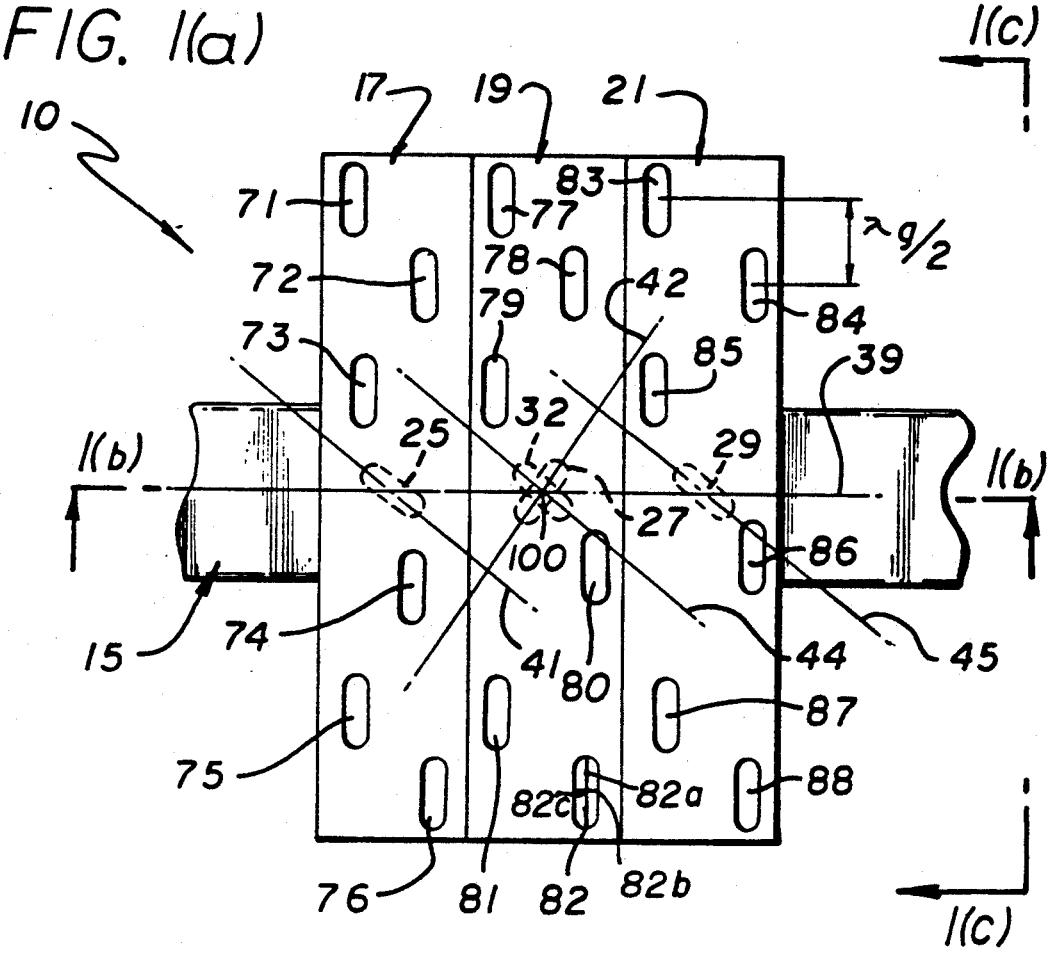
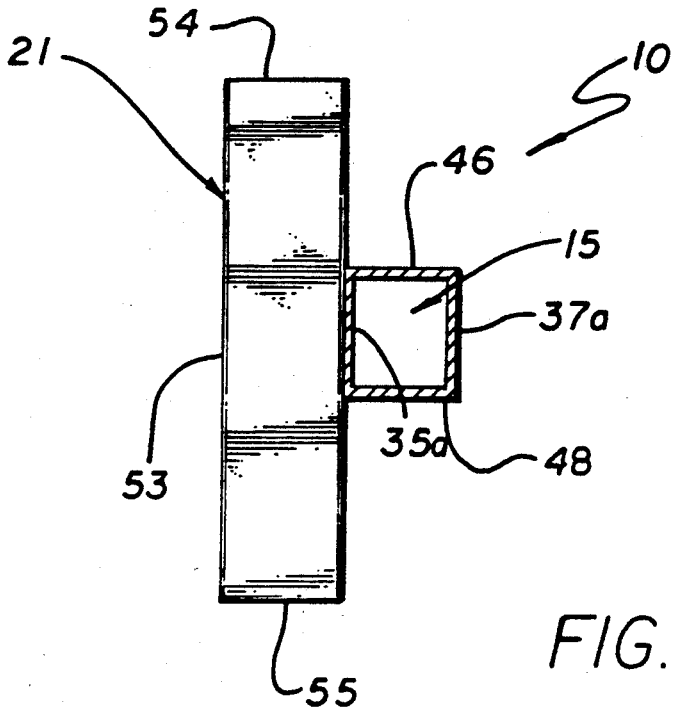
FIG. 1(c)

FIG. 1(b)
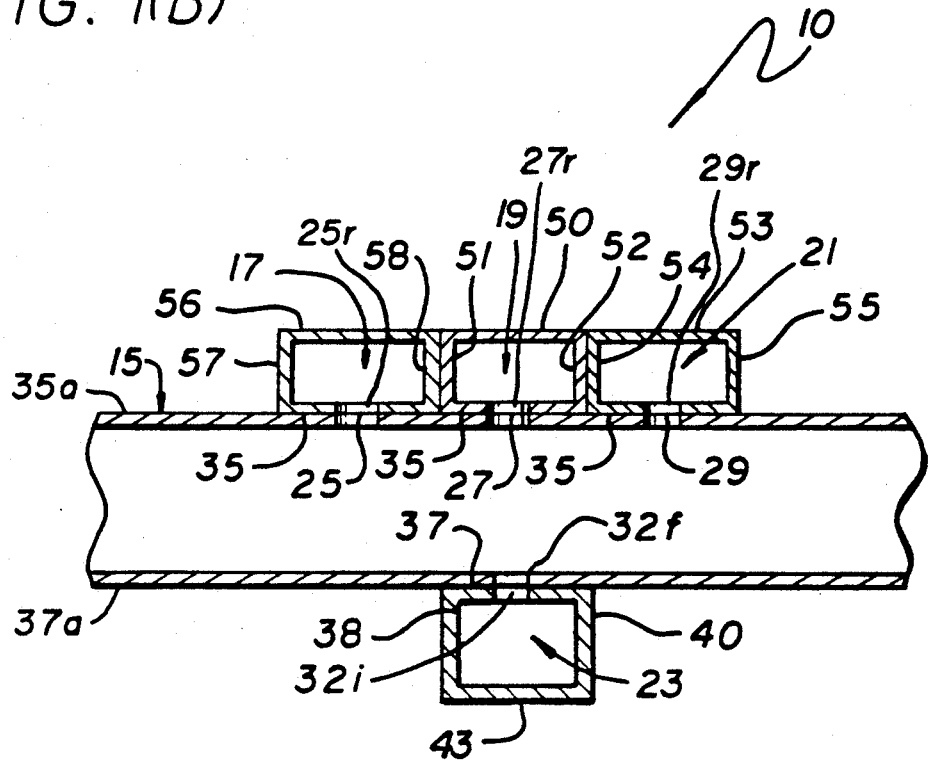
FIG. 2(a)
(PRIOR ART)
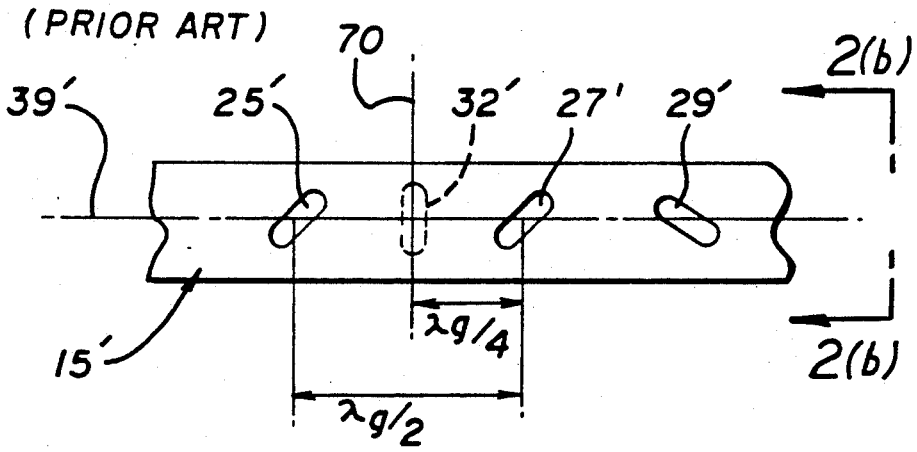
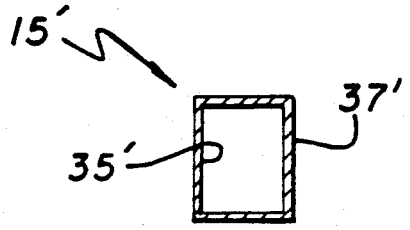
FIG. 2(b)
(PRIOR ART)

FIG. 3
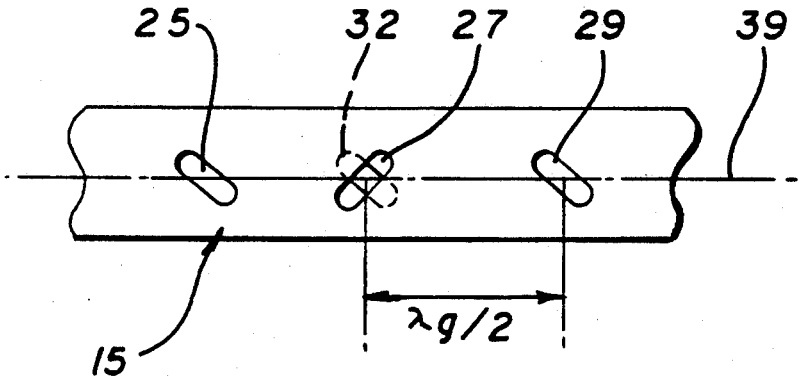
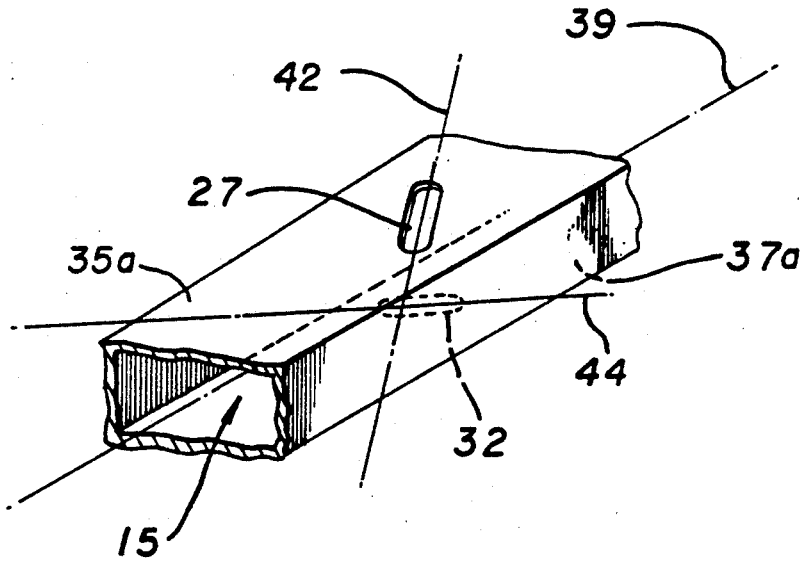
FIG. 4

FEED WAVEGUIDE FOR AN ARRAY ANTENNA

This is a continuation of application Ser. No. 07/287,364 filed Dec. 20, 1988 abandoned.

BACKGROUND OF THE INVENTION

1. Field of the Invention

The present invention relates to slot array antennas. More specifically, the present invention relates to an improved feed for a slot array antenna.

While the present invention is described herein with reference to an illustrative embodiment for a particular application, it is understood that the invention is not limited thereto. Those of ordinary skill in the art and access to the teachings provided herein will recognize additional modifications, applications and embodiments within the scope thereof.

2. Description of the Related

Planar array antennas are used for a wide variety of radar applications. One such planar array antenna is a flat plate antenna. A flat plate antenna is typically a family of coplanar linear arrays each containing a series of resonant slot radiating apertures. Microwave energy is provided to the radiating waveguides by a feed waveguide which is in turn fed by an input waveguide.

Slot coupling is a desirable technique for coupling energy from the feed waveguide to the radiating waveguides for most applications. Slot coupling, for a single feed, involves communication of energy through a slot in a broadwall of a rectangular feed waveguide and slots in a broadwall of a rectangular radiating waveguide. Energy is typically provided to the feed waveguide by an input waveguide located at either end of the feed waveguide or somewhere along the length thereof. The location of the input waveguide at the ends of the feed waveguide may limit the bandwidth of the system or be otherwise problematic because of the relative inaccessibility of the ends of the feed waveguides.

The center feeding of the feed waveguide is problematic with respect to the location of the input slot of the input waveguide relative to the feed slot of the feed waveguide. That is, if, as is common, the input slot and the feed slots are placed on opposite broad walls of the feed waveguide and at one-quarter wavelength spacing down the waveguide, an impedance inversion results on each half of the feed waveguide which must be corrected in the design. A common technique for correcting the impedance inversion involves a design in which coupling slots are at greater angles. Unfortunately, this approach typically results in larger coupling junction phase errors.

Location of the input slots on the opposite broadwall at the same position along the length of the feed waveguide as the feed slots has heretofore been avoided because of difficulty in achieving independent coupling of the input slot and the opposite feed slot.

There is therefore a need in the art for a planar array antenna feed waveguide which has an input slot located between the ends of the waveguide but does not have any associated impedance inversion.

SUMMARY OF THE INVENTION

The need in the art for a feed waveguide design that reduces coupling junction phase errors is addressed by the improved feed waveguide of the present invention. The improved feed waveguide of the present invention includes first and second slotted parallel walls. The first wall includes a first elongate slot along a first longitudinal axis. The second wall includes a second elongate slot located on the second wall opposite the first slot on the first wall. The second slot has a second longitudinal axis.

In a particular embodiment, the invention is adapted to provide a planar array antenna including at least one radiating waveguide having a first broadwall with a first elongate slot therethrough and a first longitudinal axis. A feed waveguide is coupled to the radiating waveguide and has first and second parallel walls along the length thereof. The first wall has a second elongate slot therethrough which is in communication with the first slot in the radiating waveguide. The second slot has a longitudinal axis and is aligned with the slot in the radiating waveguide. A third slot is located in the second wall opposite the second slot in the first wall and has a second longitudinal axis. An input waveguide is coupled to the feed waveguide and includes a broadwall with an elongate slot therethrough. The slot in the input waveguide is in communication with the third slot in the feed waveguide. The slot in the input waveguide has a longitudinal axis aligned with the longitudinal axis of the third slot. Thus, in accordance with the present teachings, the slot in the input waveguide is colocated with the slot in the radiating waveguide and orthogonal thereto. This arrangement mitigates impedance inversion and allows for optimum performance of an array antenna.

BRIEF DESCRIPTION OF THE DRAWINGS

FIG. 1(*a*) is an illustrative representation of a top view of a section of a flat plate slot array antenna incorporating the principles of the present invention.

FIG. 1(*b*) is an illustrative representation of a sectional side view of a section of a flat plate slot array antenna incorporating the principles of the present invention.

FIG. 1(*c*) shows a side view of a feed waveguide in a section of a flat plate slot array antenna incorporating the principles of the present invention.

FIG. 2(*a*) shows a prior art feed waveguide wherein the feed waveguide is fed via an input slot on one wall of the waveguide which is located between a series of feed slots which lie on the opposite wall of the feed waveguide.

FIG. 2(*b*) shows a end view of the feed waveguide of FIG. 2(*a*).

FIG. 3 shows the present invention feed waveguide wherein the feed waveguide is fed via an input slot on one wall of the feed waveguide and colocated with one of a series of feed slots on the opposite wall of the feed waveguide.

FIG. 4 is an expanded view showing the location of an input slot and a colocated feed slot in the feed waveguide of the present invention.

DESCRIPTION OF THE INVENTION

FIG. 1(*a*) is a top view of a section of the flat plate slot array antenna 10, incorporating the principles of the present invention. The section of the antenna 10 includes first, second and third radiating waveguides 17, 19 and 21, respectively, mounted orthogonal to a feed waveguide 15 in broadwall-to-broadwall relation. Each waveguide may be of conventional fabrication, e.g., metal or other suitably conductive material. The radiating waveguides 17, 19 and 21 are spaced along the longitudinal axis of the feed waveguide 15 and coupled thereto by a plurality of inclined slots (shown in phantom) 25, 27 and 29 respectively. The radiating waveguides 17, 19 and 21 are spaced so that they lie directly next to one another.

As shown in the sectional side view of FIG. 1(*b*), each radiating waveguide is rectangular having first and second broadwalls and first and second sidewalls. For example, the second radiating waveguide 19 has first and second broadwalls 35 and 50 and first and second sidewalls 51 and 52. Similarly, the feed waveguide 15 includes a front broadwall 35*a*, a back broadwall 37*a* and side walls 46 and 48. (See the end view of FIG. 1(*c*).) A rectangular input waveguide 23 is mounted on the back broadwall 37*a* of the feed waveguide 15 and includes a front broadwall 37, a back broadwall 43 and sidewalls 38 and 40.

The radiating waveguides 17, 19, and 21 are mounted on the front broadwall 35*a* of the feed waveguide 15. The feed waveguide 15 is coupled to the radiating waveguides by a plurality of elongate inclined feed slots 25, 27, and 29, in the front broadwall 35*a* of the feed waveguide 15. A plurality of congruent elongate inclined slots 25*r*, 27*r* and 29*r* are formed in the radiating waveguides 17, 19 and 21, respectively, as shown in FIG. 1(*b*). Each of the radiating waveguides 17, 19 and 21 contains a plurality of radiating slots which receive the energy from the feed slots 25, 27 and 29, respectively. Each of the radiating slots are spaced one-half wavelength from each neighboring radiating slot. The radiating waveguide 17 contains the radiating slots 71, 72, 73, 74, 75 and 76. The radiating waveguide 19 contains the radiating slots 77, 78, 79, 80, 81 and 82. The radiating waveguide 21 contains the radiating slots 83, 84, 85, 86, 87 and 88. Each of the feed slots 25, 27 and 29 lie equidistant between two radiating slots. Thus, there is a one-quarter wavelength spacing from each feed slot and the closest radiating slot. Each feed slot 25, 27, and 29 is inclined with respect to a longitudinal axis 39 of the feed waveguide 15 and has a longitudinal axis 41, 42, and 45 respectively. The feed slots 25, 27 and 29 are shown in phantom in FIG. 1(*a*).

The feed waveguide 15 also includes an input slot 32 on the back wall 37*a* thereof. The input slot 32 is comprised of a slot $32_f$ in the feed waveguide 15 and a slot $32_i$ in an input waveguide 23. The input slot 32 is also inclined with respect to the longitudinal axis 39 of the feed waveguide 15 and has a longitudinal axis 44. Each elongate inclined slot within the radiating waveguides 17, 19 and 21, the feed waveguide 15 and the input waveguide 23 includes a major axis and a minor axis. As an example, radiating slot 82 of the second radiating waveguide 19 includes a major axis 82*a* and a minor axis 82*b* which intersect to define a center 82*c* of the slot 82. The major axis of any slot would be congruent with the longitudinal axis of that slot. As discussed below, a particularly novel feature of the present invention is the colocation of the input slot 32 with the feed slot 27 along the longitudinal axis 39 of the feed waveguide 15. The colocation of the input slot 32 relative to a feed slot 27 allows for the coupling of energy from the input waveguide 23 to the feed waveguide 15 without an impedance inversion. The colocation of the input slot 32 with a feed slot 27 is permitted by the orthogonal arrangement of the input slot 32 relative to the feed slot 27. That is, the longitudinal axis 42 of the input slot 32 is orthogonal to the longitudinal axis 42 of the feed slot 27. (This is illustrated more clearly in phantom in FIG. 1(*a*).) Thus, energy is provided to the feed waveguide 15 by the input waveguide 23 via the slot 32. The feed waveguide 15 then couples the energy to the slots 25*r*, 27*r* and 29*r*, respectively, of the radiating waveguides 17, 19 and 21 via slots 25, 27 and 29 on the broadwall 35*a*. The energy is then radiated to the atmosphere by the radiating waveguides 17, 19 and 21 in a conventional manner.

The advantageous design of the improved feed technique of the present invention is appreciated with reference to the conventional feed arrangement of FIG. 2(*a*). FIG. 2(*a*) is an illustrative representation of a conventional feed waveguide 15' which is fed via an input slot 32' located between the ends of the feed waveguide 15'. FIG. 2(*b*) is an end view of the conventional feed waveguide 15' showing the front and back broadwalls 35' and 37', respectively. The conventional feed waveguide 15' includes a plurality of feed slots 25', 27', 29', on the front broadwall 35' of the feed waveguide 15' inclined with respect to the longitudinal axis 39' thereof and the input slot 32' (shown in phantom) on the back broadwall 37' of the feed waveguide 15'. The input slot 32' has a longitudinal axis 70 which is generally normal to the longitudinal axis 39' of the feed waveguide 15'. The two feed slots 25' and 27' are generally separated by a distance of one half of the wavelength of the operating frequency. The input slot 32' is located on the back broadwall 37' of the feed waveguide 15' between two feed slots 25' and 27' on the front broadwall 35' thereof. The input slot 32' is located equidistant between the two feed slots 25' and 27'. There is therefore a one-quarter wavelength spacing between the input slot 32' and each of the two feed slots 25' and 27'. The one-quarter wavelength spacing between the feed slots 25' and 27' and input slot 32' causes a one-quarter wave inversion in the characteristic impedance of the waveguide in each half of the feed waveguide 15'. This has previously precluded the centerfeeding of feed waveguides for many conventional planar array antennas.

As mentioned in the Background of the Invention, an alternate conventional method of feeding the waveguide 15' is via either end of the feed waveguide 15'. The advantage of the design is that impedance inversion is avoided. However, as previously discussed, the location of the input waveguide at the ends of the feed waveguide 15' may limit the bandwidth of the system or be otherwise problematic because of the relative inaccessibility of the ends of the feed waveguide 15'.

FIG. 3 is a top view of the feed waveguide 15 constructed in accordance with the principles of the present invention. As mentioned above, the input slot 32 comprised of slots 32*i* and 32*f* is colocated with a feed slot 27 and the congruent radiating waveguide slot 27*r* and orthogonal thereto. As can be seen from FIGS. 1(*a*), 1(*b*) and 3, the major and minor axes of feed slot 27 and slot 27*r* are congruent and thus their slot centers are aligned. Likewise, the major and minor axes of input slots 32*i* and 32*f* are also congruent and their centers are aligned. Further, the major and minor axes of the congruent slots 27 and 27*r* are orthogonal to the major and minor axes of the congruent slots 32*i* and 32*f* such that the centers of each slot 27, 27*r*, 32*i* and 32*f* are aligned along a vertical z-axis 100 as shown in FIG. 1(*a*). This design is effective to mitigate the impedance inversion. A direct consequence of which is that smaller values of coupling slot angles can be used which, in turn, reduces coupling junction phase errors.

The expanded view of FIG. 4 better illustrates the advantageous location of an input slot 32 and a colocated feed slot 27 of a section of a feed waveguide 15 of the present invention. The input slot 32 is shown in phantom to indicate that it is located on the bottom broadwall 37*a* of the feed waveguide 15. The feed slot 27 is located on the top broadwall 35*a* of the feed waveguide 15. Both the input slot 32 and the feed slot 27 are inclined with respect to the longitudinal axis 39 of the feed waveguide 15. The input slot 32 has a longitudinal axis 44 which is orthogonal to the longitudinal axis 42 of the feed slot 27. The input slot 32 couples energy from an input waveguide 23 to the feed waveguide 15. The feed slot 27 couples energy from the feed waveguide 15 to a radiating waveguide.

To facilitate understanding of the claim language it should be noted that slot 27*r* is the "first elongate slot", slot 27 is the "second elongate slot", slot 32*f* is the "third elongate slot" and slot 32*i* is the "fourth elongate slot".

Those skilled in the art will appreciate that an improved feed waveguide design has been disclosed which provides a reduction of coupling junction phase errors. Although the present invention has been described with reference to a particular illustrative embodiments for particular illustrative applications, those of ordinary skill in the art, having access to the present teachings, will recognize additional modifications, applications, and embodiments within the scope thereof. For example, the number and orientations of the inclined slots is not critical to the invention. And while the invention is described with reference to a planar array antenna, the present invention is not limited thereto. The feed arrangement of the present invention is also advantageous in a linear array antenna such as a small Ka-band flat plate antenna. In addition, common forms of input slot excitation may be utilized in connection with present teachings.

It is intended by the appended claims to cover any and all such modifications, applications, and embodiments within the scope of the invention.

Accordingly, what is claimed is:

1. A planar array antenna comprising:

at least one radiating waveguide having a first broadwall with a first elongate slot therethrough having a first longitudinal axis passing through a center of said first elongate slot;

a feed waveguide having first and second parallel walls along the length thereof, said first parallel wall having a second elongate slot therethrough positioned adjacent to said first elongate slot and having a second longitudinal axis passing through a center of said second elongate slot and parallel with said first longitudinal axis and said second parallel wall having a third elongate slot therethrough located opposite said second elongate slot and having a third longitudinal axis passing through a center of said third elongate slot;

an input waveguide having a broadwall with a fourth elongate slot therethrough positioned adjacent to said third elongate slot and having a fourth longitudinal axis passing through a center of said fourth elongate slot, wherein the centers of said first, second, third and fourth elongate slots are aligned along a vertical z-axis such that the first, second, third and fourth slots are in alignment permitting the coupling of energy from said input waveguide to said feed waveguide without an impedance; and said fourth longitudinal axis of said fourth elongate slot in said input waveguide is orthogonal to said second longitudinal axis of said second elongate slot in said feed waveguide.

* * * * *